US009012748B2

(12) United States Patent
Vumbaco et al.

(10) Patent No.: US 9,012,748 B2
(45) Date of Patent: Apr. 21, 2015

(54) ULTIMATE FLEXIBILITY WIRELESS SYSTEM FOR REMOTE AUDIO EFFECTS PEDALS

(71) Applicant: FXCONNECTX, LLC, Holiday, FL (US)

(72) Inventors: Michael J. Vumbaco, Holiday, FL (US); James Arcidiacono, Holiday, FL (US)

(73) Assignee: FXCONNECTX, LLC, Holiday, FL (US)

( * ) Notice: Subject to any disclaimer, the term of this patent is extended or adjusted under 35 U.S.C. 154(b) by 109 days.

(21) Appl. No.: 13/670,353

(22) Filed: Nov. 6, 2012

(65) Prior Publication Data

US 2014/0126609 A1 May 8, 2014

(51) Int. Cl.
*G10H 3/00* (2006.01)
*G10H 1/34* (2006.01)

(52) U.S. Cl.
CPC ..... *G10H 1/34* (2013.01)

(58) Field of Classification Search
USPC ..... 84/1
See application file for complete search history.

(56) References Cited

U.S. PATENT DOCUMENTS

| | | | | |
|---|---|---|---|---|
| 5,576,507 | A | 11/1996 | LaMarra | |
| 5,700,966 | A | 12/1997 | LaMarra | |
| 7,602,927 | B2 * | 10/2009 | Smith | 381/120 |
| 7,684,572 | B2 * | 3/2010 | Ito | 381/119 |
| 7,842,875 | B2 | 11/2010 | Villa et al. | |
| 8,553,896 | B2 * | 10/2013 | Dietz | 381/58 |
| 8,609,973 | B2 * | 12/2013 | D'Amours | 84/746 |
| 2005/0056142 | A1 * | 3/2005 | Mapleston et al. | 84/645 |
| 2008/0216638 | A1 | 9/2008 | Hustig | |
| 2008/0229914 | A1 * | 9/2008 | Nathanial | 84/644 |
| 2009/0129605 | A1 | 5/2009 | Camp, Jr. et al. | |
| 2010/0269670 | A1 | 10/2010 | O'Connor et al. | |
| 2010/0275760 | A1 | 11/2010 | Gain et al. | |
| 2010/0290638 | A1 * | 11/2010 | Heineman | 381/77 |
| 2011/0025912 | A1 | 2/2011 | Regler | |
| 2012/0160079 | A1 | 6/2012 | Little et al. | |
| 2013/0298752 | A1 * | 11/2013 | Juszkiewicz | 84/746 |

(Continued)

FOREIGN PATENT DOCUMENTS

| | | | |
|---|---|---|---|
| EP | 2031904 | A2 | 3/2009 |
| EP | 2129166 | A2 | 12/2009 |
| KR | 10-2011-0107516 | A | 10/2011 |

(Continued)

OTHER PUBLICATIONS

International Search Report and Written Opinion for International Application No. PCT/US2012/063743, filed Nov. 6, 2012, mailed May 16, 2013, 10 pages.
International Search Report and Written Opinion for International Application No. PCT/US2012/059407, filed Oct. 9, 2012, mailed Jan. 29, 2013, 9 pages.

*Primary Examiner* — Christopher Uhlir
(74) *Attorney, Agent, or Firm* — Christie, Parker & Hale, LLP

(57) ABSTRACT

A system for providing wireless connections in configuring an instrument or microphone with audio effects, effects pedal boards, mixers, and other studio equipment. The signal from an audio source such as an instrument or microphone is connected to a main unit, from which it is transmitted via wireless link to a floor unit connected to one or more effects pedals or other studio equipment. After processing, the audio signal is returned via wireless link to the main unit and then routed to an amplifier.

21 Claims, 10 Drawing Sheets

(56) References Cited

U.S. PATENT DOCUMENTS

| | | | | |
|---|---|---|---|---|
| 2013/0327201 | A1* | 12/2013 | Urry et al. | 84/626 |
| 2014/0090547 | A1* | 4/2014 | Udell, III | 84/626 |

FOREIGN PATENT DOCUMENTS

| | | | |
|---|---|---|---|
| WO | WO 2011/118900 | A1 | 9/2011 |
| WO | WO 2012/058646 | A1 | 5/2012 |

* cited by examiner

ULTIMATE FLEXIBILITY WIRELESS SYSTEM FOR REMOTE AUDIO EFFECTS PEDALS

FIELD

The present invention relates to the use of effects pedals when performing music, and more particularly to a system for using wireless connections to eliminate cabling in configuring an instrument or microphone with audio effects, effects pedal boards, mixers, and other studio equipment.

BACKGROUND

When performing music using an amplified instrument it is often desirable to modify the audio signal electronically before amplifying the signal and converting it to audible sound. For example, a musician playing an electric guitar at the front of a stage may have one or more electronic effects pedals, or a pedal board including one or more effects pedals, connected between the guitar and the amplifier, which may be at the back of the stage. Such an arrangement may result in a need for one or more long audio cables.

Even greater cable lengths may be needed, for example, if a musician is performing at the front of a stage using an electric guitar connected by wireless audio signal link to a receiver at the back of the stage. In this case it may be necessary to route the audio signal from the receiver to effects pedals at the front of the stage, and back to an amplifier at the back of the stage, using audio cables spanning, in total, twice the depth of the stage. Long audio cables may compromise audio sound quality. Thus, there is a need for a system for connecting effects pedals into an audio signal system which avoids the need for long cables.

SUMMARY

The present invention relates to wireless control of audio signal switching. In one embodiment, a wireless transmitter transmits control signals to a wireless receiver in a main unit, which, in response, switches an audio signal accordingly. The system for wireless switching and controlling of audio signals may be used for musical audio applications such as audio effects, effects pedal boards, mixers, and studio equipment.

According to an embodiment of the present invention there is provided a system for forming a wireless connection to a remote pedal board, the system including: a main unit, and a floor unit; the main unit including an audio input, an audio output, a main unit wireless transmitter and a main unit wireless receiver; the floor unit including an effects send output, an effects return input, a floor unit wireless transmitter and a floor unit wireless receiver; the main unit wireless transmitter configured to transmit an audio signal to the floor unit wireless receiver and the floor unit wireless transmitter configured to transmit the audio signal to the main unit wireless receiver; the floor unit configured to route the audio signal from the floor unit wireless receiver to the effects send output; and from the effects return input to the floor unit wireless transmitter; and the main unit configured to selectively operate in a first audio control state, wherein, when the main unit is selected to operate in the first audio control state, the audio signal is routed from the audio input to the main unit wireless transmitter; and from the main unit wireless receiver to the audio output.

In one embodiment, the main unit is further configured to selectively operate in a second audio control state, wherein, when the main unit is selected to operate in the second audio control state, the audio signal is routed from the audio input to the audio output.

In one embodiment, the main unit further includes a physically actuated switch, configured to cause the main unit to operate in the first audio control state when the physically actuated switch is activated, and to operate in the second audio control state when the physically actuated switch is deactivated.

In one embodiment, the physically actuated switch is a manually actuated switch.

In one embodiment, the main unit further includes a physically actuated switch, and the main unit is configured to transition from one of the first audio control state and the second audio control state to the other one of the first audio control state and the second audio control state when the physically activated switch is activated after having been deactivated.

In one embodiment, the floor unit further includes a physically actuated switch; the floor unit wireless transmitter is further configured to transmit a control signal from the physically actuated switch to the main unit wireless receiver; and the main unit is configured to operate in the first audio control state when the physically actuated switch is activated, and to operate in the second audio control state when the physically actuated switch is deactivated.

In one embodiment, the physically actuated switch is a foot actuated switch.

In one embodiment, the floor unit further includes a physically actuated switch, the floor unit wireless transmitter is further configured to transmit a control signal from the physically actuated switch to the main unit wireless receiver, and the main unit is configured to transition from one of the first audio control state and the second audio control state to the other one of the first audio control state and the second audio control state when the physically activated switch is activated after having been deactivated.

In one embodiment, the main unit further includes a first physically actuated switch; the floor unit further includes a second physically actuated switch; the floor unit wireless transmitter is further configured to transmit a control signal from the physically actuated switch to the main unit wireless receiver; and the main unit is configured to transition from one of the first audio control state and the second audio control state to the other one of the first audio control state and the second audio control state when the first physically activated switch is activated after having been deactivated, or the second physically activated switch is activated after having been deactivated.

In one embodiment, the main unit is further configured to selectively operate in an unmuted state or a muted state, wherein, when the main unit is selected to operate in the muted state, the audio output is disabled.

In one embodiment, the main unit further includes a physically actuated switch, and the main unit is configured to operate in the muted state when the physically activated switch is activated.

In one embodiment, the floor unit wireless transmitter is further configured to transmit a control signal from the physically actuated switch to the main unit wireless receiver, and the main unit is configured to operate in the muted state when the physically activated switch is activated.

In one embodiment, the main unit further comprises a switching control connector comprising a conductor; and the main unit is further configured to selectively operate in a first control output state or a second control output state, wherein, when the main unit is selected to operate in the first control output state, the conductor is configured to be disconnected, and when the main unit selected to operate in the second control output state, the conductor is configured to be connected to ground.

In one embodiment, the floor unit wireless transmitter is configured to transmit the audio signal to the main unit wireless receiver using a wireless link having multiple channels.

In one embodiment, the wireless link employs spread spectrum technology.

In one embodiment, the audio input is a wireless audio input.

In one embodiment, the system includes a main unit, and an audio amplifier, including a preamplifier input; a preamplifier output; and a power amplifier input; wherein an audio signal source is connected to the preamplifier input; the preamplifier input is connected to the audio input; and the audio output is connected to the power amplifier input.

In one embodiment, the audio signal source is connected to the preamplifier input via a wireless audio link.

BRIEF DESCRIPTION OF THE DRAWINGS

These and other features and advantages of the present invention will become appreciated as the same become better understood with reference to the specification, claims and appended drawings wherein:

DETAILED DESCRIPTION

The detailed description set forth below in connection with the appended drawings is intended as a description of exemplary embodiments of an ultimate flexibility wireless system for remote audio effects provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
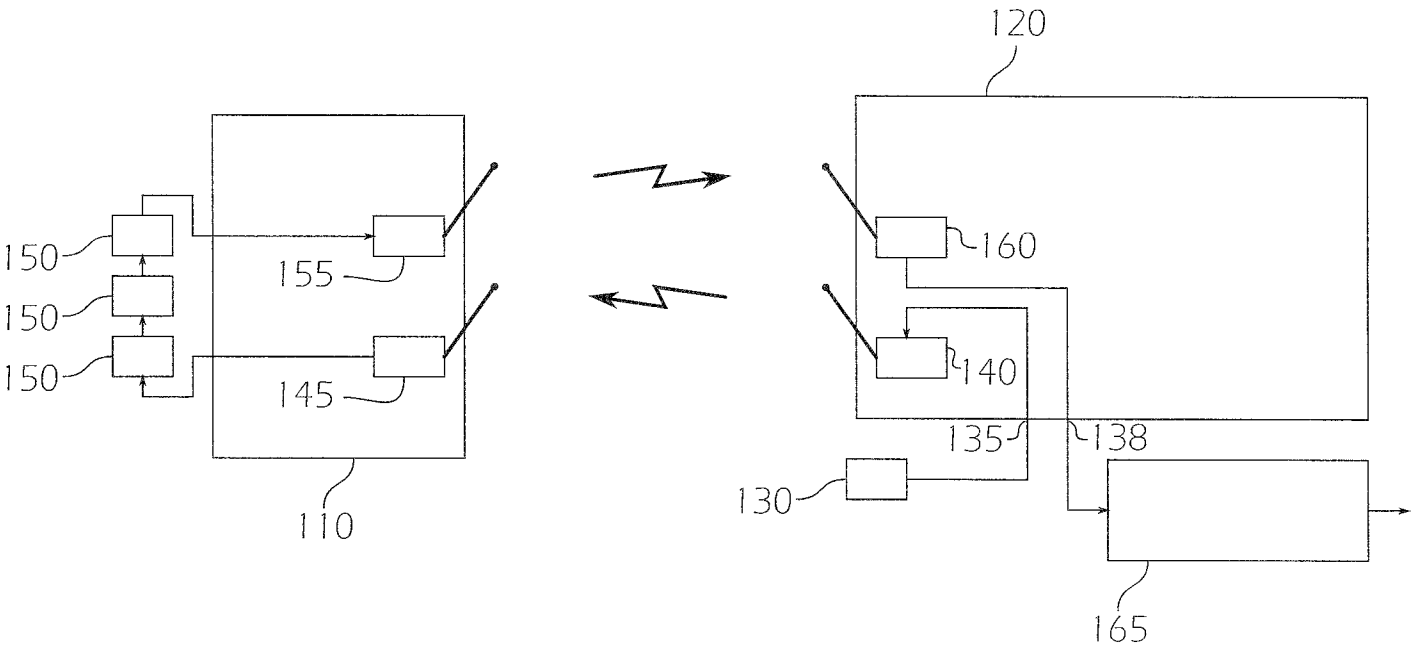
FIG. 1 is a block diagram of a system for wireless remote installation of effects pedals according to an embodiment of the present invention.

Referring to FIG. 1, in one embodiment a main unit 120 may be used together with a floor unit 110 to locate effects pedals 150 remotely from the main unit 120 without the use of cables. An audio source 130, such as an electric guitar, microphone, piece of studio equipment, or the like, may be connected to the main unit 120, within which the signal from the audio source 130 may be transmitted to the floor unit 110 over an outbound wireless link composed of a main unit wireless transmitter 140 and a floor unit wireless receiver 145. In the floor unit 110, the received audio signal may be routed from the floor unit wireless receiver 145 to a send output, from which it may be routed through one or more effects pedals 150 and back to the return input on the floor unit 110. From the return input on the floor unit 110, the audio signal, modified by the action of the effects pedals 150, may be returned to the main unit 120 via the return wireless link, and routed, through a main unit audio output 138, to an amplifier 165. The amplifier 165 amplifies the audio signal and transmits, to external speakers, an electrical signal suitable for driving such speakers, or, if the amplifier 165 includes integral speakers, it may output an amplified acoustic signal. Although the main unit wireless transmitter 140 and the main unit wireless receiver 160 are illustrated as wholly independent parts, they may be integrated into one component of the main unit 120, sharing, for example, an antenna that may be used both to transmit and to receive. The floor unit wireless receiver 145 and the floor unit wireless transmitter 155 may also similarly be integrated into one unit. In operation, a musician may position the floor unit 110 and effects pedals 150 at the front of a stage, and perform there, while the amplifier and main unit are located at the back of the stage.

Figure 2:
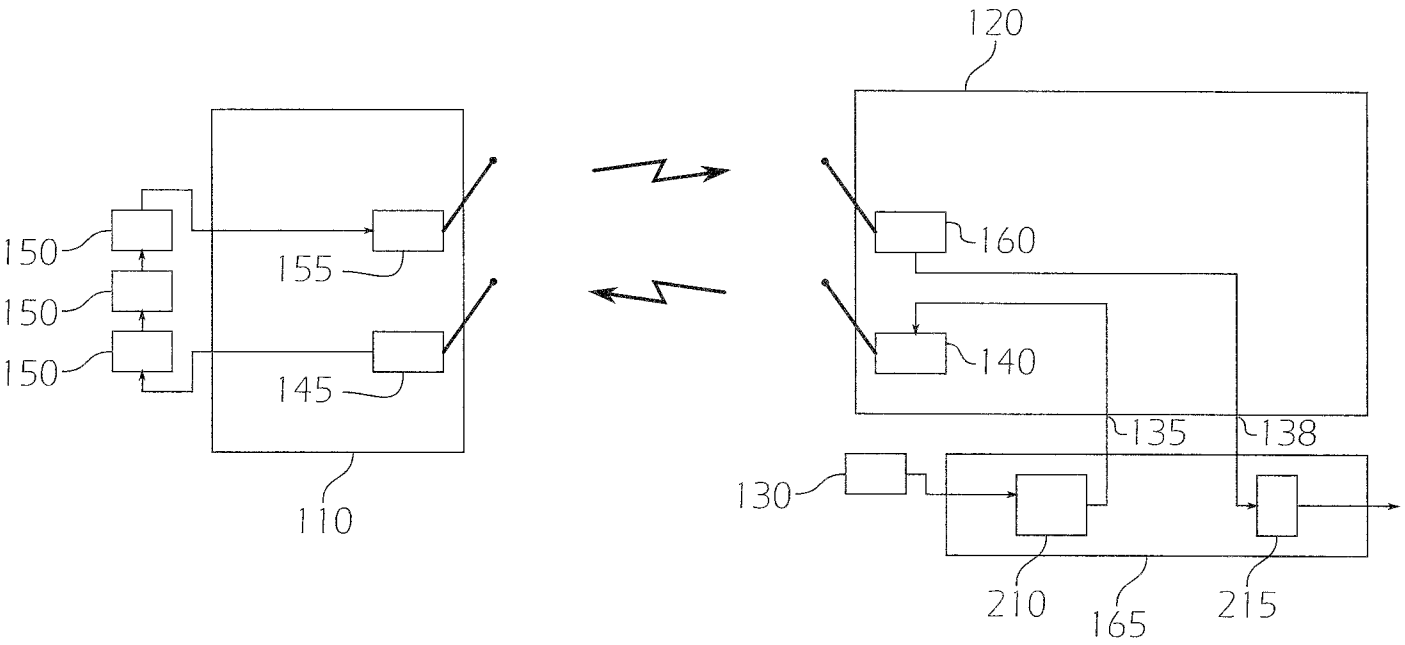
FIG. 2 is a block diagram of a system for wireless remote installation of effects pedals between preamplifier and power amplifier stages according to an embodiment of the present invention.

Referring to FIG. 2, the embodiment comprising a main unit 120 and a floor unit 110 may also be employed in a configuration in which the amplifier 165 includes separate preamplifier 210 and power amplifier 215 stages. When using such an amplifier 165, a musician may obtain superior sound by connecting the effects pedals 150 in between the preamplifier 210 and the power amplifier 215. In the absence of the present invention, such an audio signal chain may require considerable lengths of cabling. If, for example, the musician and her instrument, and the effects pedals 150, are at the front of a stage, and the amplifier 165 is at the back of the stage, three cables, each spanning the distance from the front to the back of the stage may be needed: one to connect the instrument to the input of the preamplifier 210, one to connect the output of the preamplifier 210 to the input of the chain of effects pedals 150, and one to connect the output of the chain of effects pedals 150 to the power amplifier 215. In the embodiment of FIG. 2, two of these three cables are unnecessary, and the attendant trip hazards and degradation of audio quality may be avoided.

Figure 3A:
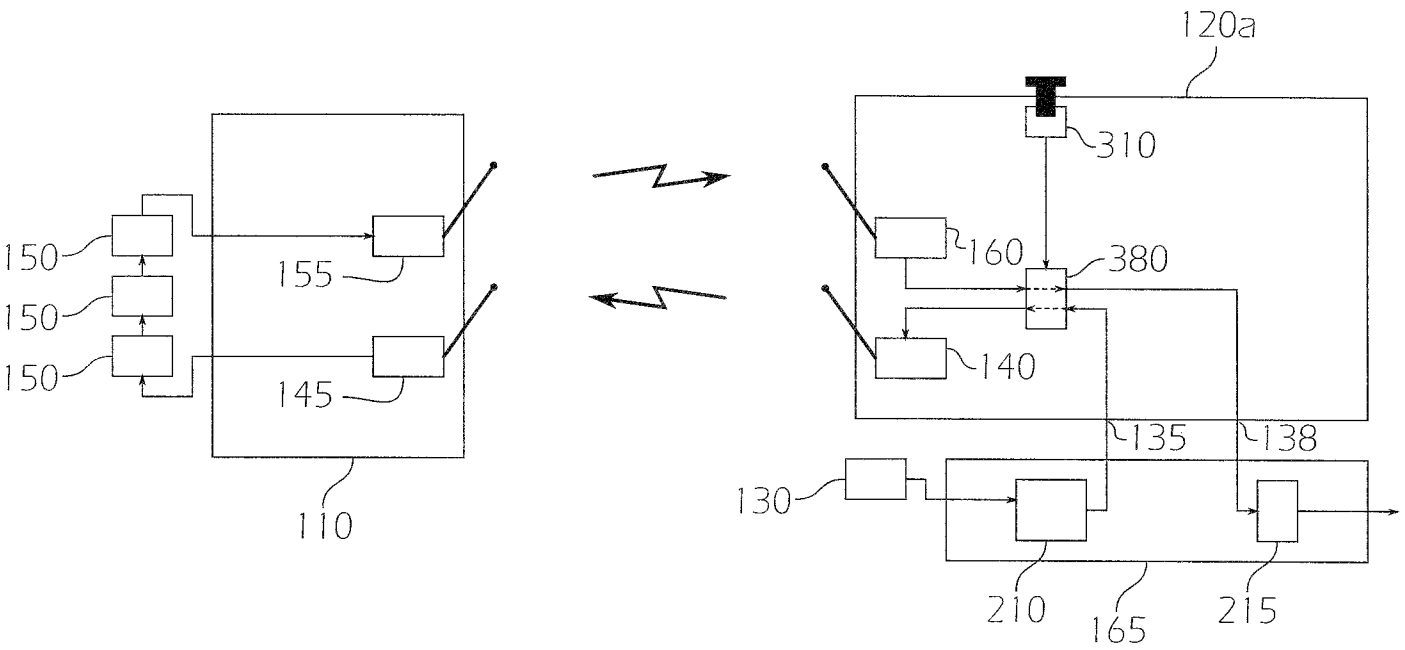
FIG. 3A is a block diagram of a system for wireless remote installation of effects pedals in the loop active state according to an embodiment of the present invention.
Figure 3B:
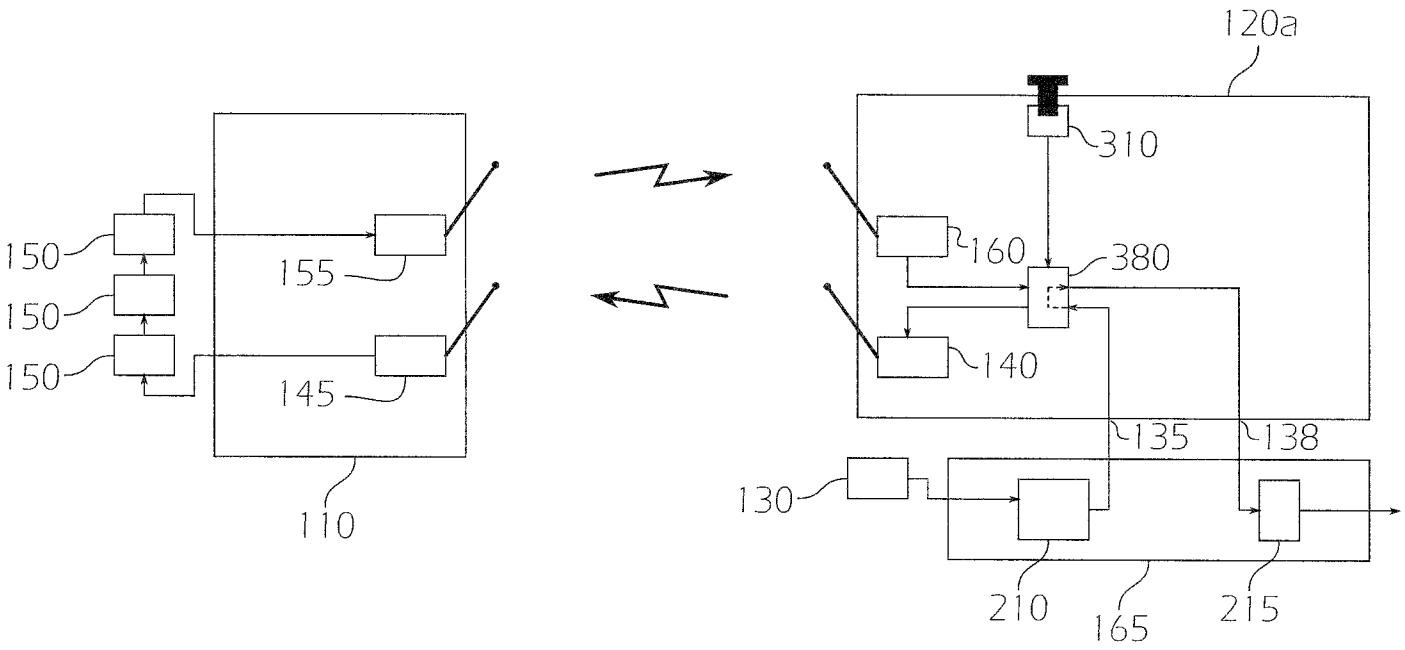
FIG. 3B is a block diagram of a system for wireless remote installation of effects pedals in the bypass state according to an embodiment of the present invention.

Referring to FIG. 3A and FIG. 3B, in one embodiment, the main unit 120*a* may further include an audio signal routing block 380, and the main unit 120*a* may be configured to operate in either of two audio control states, for selecting whether or not effects are applied to the audio signal. In a first audio control state, the audio signal may be routed by the audio signal routing block 380 as illustrated in FIG. 3A, viz., to the floor unit 110, through the effects pedals 150, and back to the main unit 120*a*. This state may be referred to as the loop, active state, because in this state the effects loop is active. Referring to FIG. 3B, in a second audio control state, the audio signal may be routed directly from the main unit audio input 135 to the main unit audio output 138, bypassing the floor unit 110 and the effects pedals 150. This state may be referred to as the bypass state because in this state the effects loop is bypassed. A main unit control switch 310, which may for example be a physically actuated switch installed on the front panel of the main unit 120*a*, may be used to select between the two audio control states.

Figure 4:
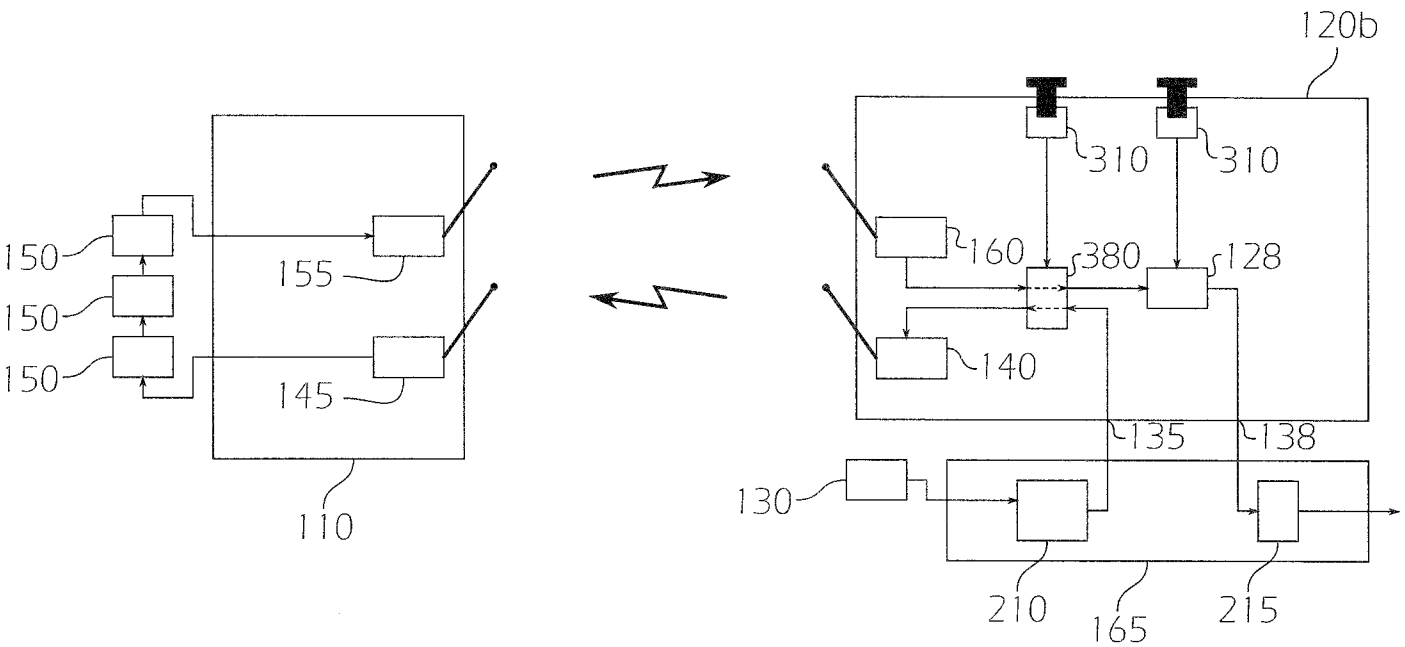
FIG. 4 is a block diagram of a system for wireless remote installation of effects pedals with a mute function according to an embodiment of the present invention.

Referring to FIG. 4, the main unit 120*b* may include a mute block 128 having the effect that when the main unit 120*b* is in a muted state, the audio output is disabled, for example by being connected to ground. Whether the main unit 120*b* is in a muted or unmuted state may be controlled by a main unit control switch 310, which may for example be a physically actuated switch installed on the front panel of the main unit 120*b*.

Figure 5:
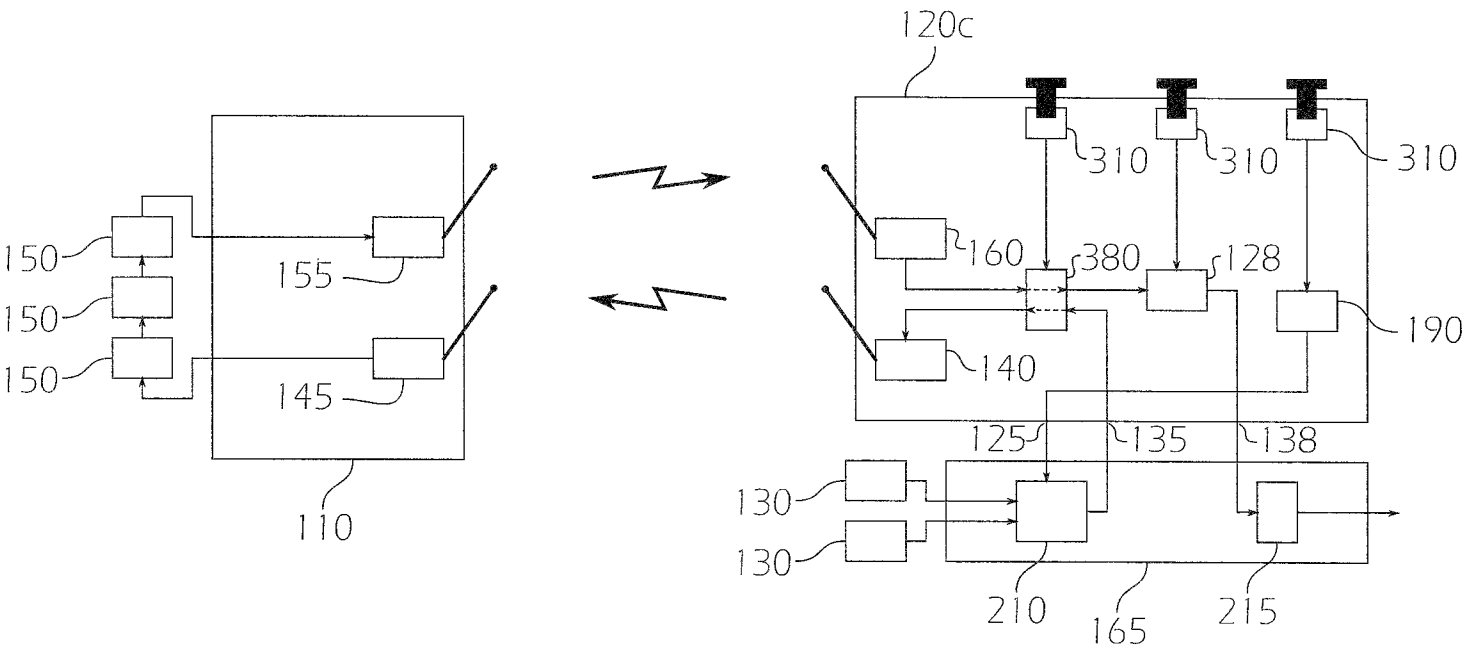
FIG. 5 is a block diagram of a system for wireless remote installation of effects pedals with an A/B select control capability according to an embodiment of the present invention.

Referring to FIG. 5, in another embodiment, the main unit 120*c* has one or more main unit control outputs 125 for causing external equipment or devices to switch between states. For example, the amplifier 165 may have two preamplifier inputs identified as "A" and "B" respectively, and an A/B select control input which may be used to control which of the two inputs is selected to be amplified. Such a control input may be controlled by a main unit control output 125 which is either in a grounded state or in an open state. In particular, the main unit control output 125 may include a switching control connector having a conductor which in in one state is conductively connected to ground and in the other state is disconnected. A similar control output may also be used to control an effects pedal 150 designed to accept such a control input. Each main unit control output 125 may be controlled, via a control block 190, by a main unit control switch 310, which may for example be a physically actuated switch installed on the front panel of the main unit 120*c*.

Each main unit control switch 310 may be a physically actuated switch on the main unit 120*c*, e.g., a finger-actuated toggle or pushbutton switch on a the main unit enclosure, or any other switch including without limitation an external foot pedal connected to the main unit 120*c* by a cable. Such a switch may be a maintained contact switch, with an active position and an inactive position (e.g., the up position and the down position, for a toggle switch) so that, for example, when the switch is in the active position the main unit 120*c* is muted, and when the switch is in the inactive position, the main unit 120*c* is unmuted. Similarly the state of the main unit control output 125 may be controlled by, for example, a toggle switch, so that when the toggle switch is in the up position, the main unit 120*c* controls the preamplifier 210 to select the A input, and when the toggle switch is in the down position, the main unit 120*c* controls the preamplifier 210 to select the B input.

Figure 6A:
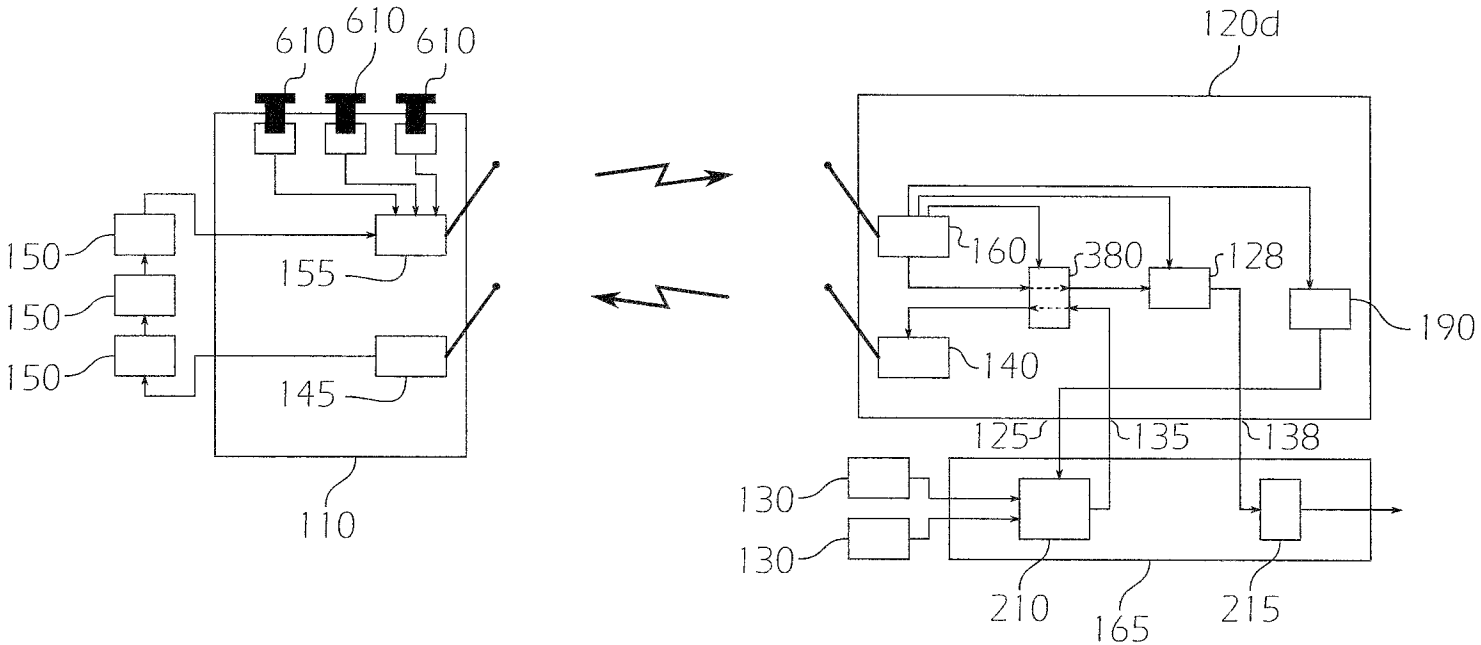
FIG. 6A is a block diagram of a system for wireless remote installation of effects pedals with state changing capability in a floor unit according to an embodiment of the present invention.

Control of various aspects of the main unit state, such as bypass state, the mute state, and the control output state of one or more control outputs may also be accomplished, in one embodiment, from the floor unit 110, via a suitably configured wireless link. Referring to FIG. 6A, the floor unit wireless transmitter 155 may, for example, be capable of transmitting multiple independent channels, and the main unit wireless receiver 160 may be capable of receiving the channels independently. This may be accomplished using different frequencies for the different channels, or by some other technique such as code division multiple access (CDMA) or other spread spectrum technology. In one embodiment, one such channel is used to transmit the audio signal back to the main unit 120*d*, and a separate channel is used to control the audio control state, the muting state, or the control output state of the main unit 120*d*. In this embodiment, the floor unit 110 may be equipped with one or more physically actuated switches 610, such as foot pedal switches integrated into the floor unit 110, or, as in the case of the main unit 120*c* (FIG. 5), any other variety of physically actuated switch. These floor unit control switches 610 may then control the state of the main unit 120*d*, via the additional channels in the wireless link, in the same manner as the main unit control switches 310 (FIG. 5).

Figure 6B:
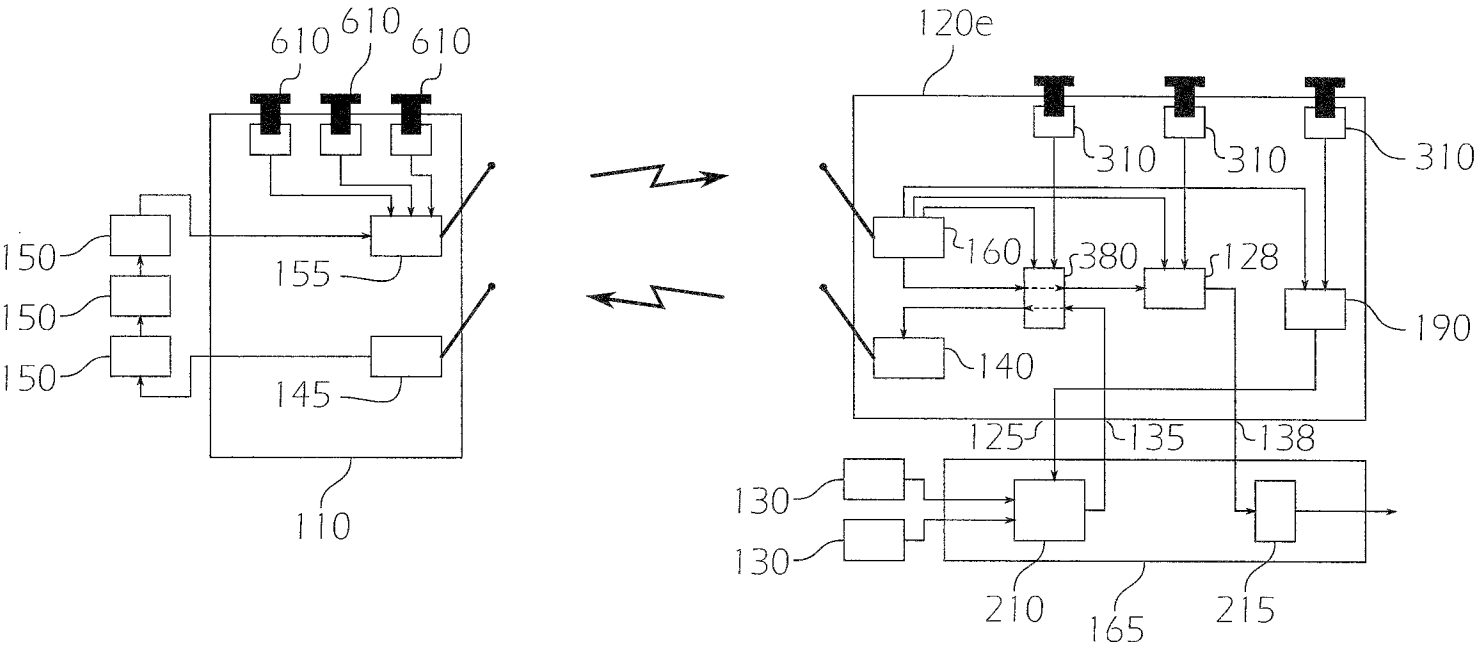
FIG. 6B is a block diagram of a system for wireless remote installation of effects pedals with state changing capability in a floor unit and in a main unit according to an embodiment of the present invention.

The audio signal routing block 380, mute block 128, and control blocks 190 in the main unit 120*d* may be constructed using relays, which may select the path the audio signal takes, or connect the audio output to ground, or connect a main unit control output 125 to ground, respectively. Referring to FIG. 6A, if the main unit state is under the control of the floor unit 110, then outputs from the corresponding channels of the main unit wireless receiver 160 may be connected to the coils of the corresponding relays to energize or de-energize them. In another embodiment (FIG. 5), control of the state of the main unit 120*c* may be accomplished directly by the main unit control switches 310, each of which may, depending on its setting, connect the coil of a relay in a corresponding audio signal routing block 380, mute block 128, or control block 190 to a source of power to energize the relay, or, in the other setting of the switch, disconnect the coil of the relay to de-energize it. Referring to FIG. 6B, in another embodiment, control switches may be present on both the main unit 120*e* and the floor unit 110 and control may be effected by any of the switches, any of which may cause a corresponding relay to be energized when the switch is in the appropriate position.

Figure 7:
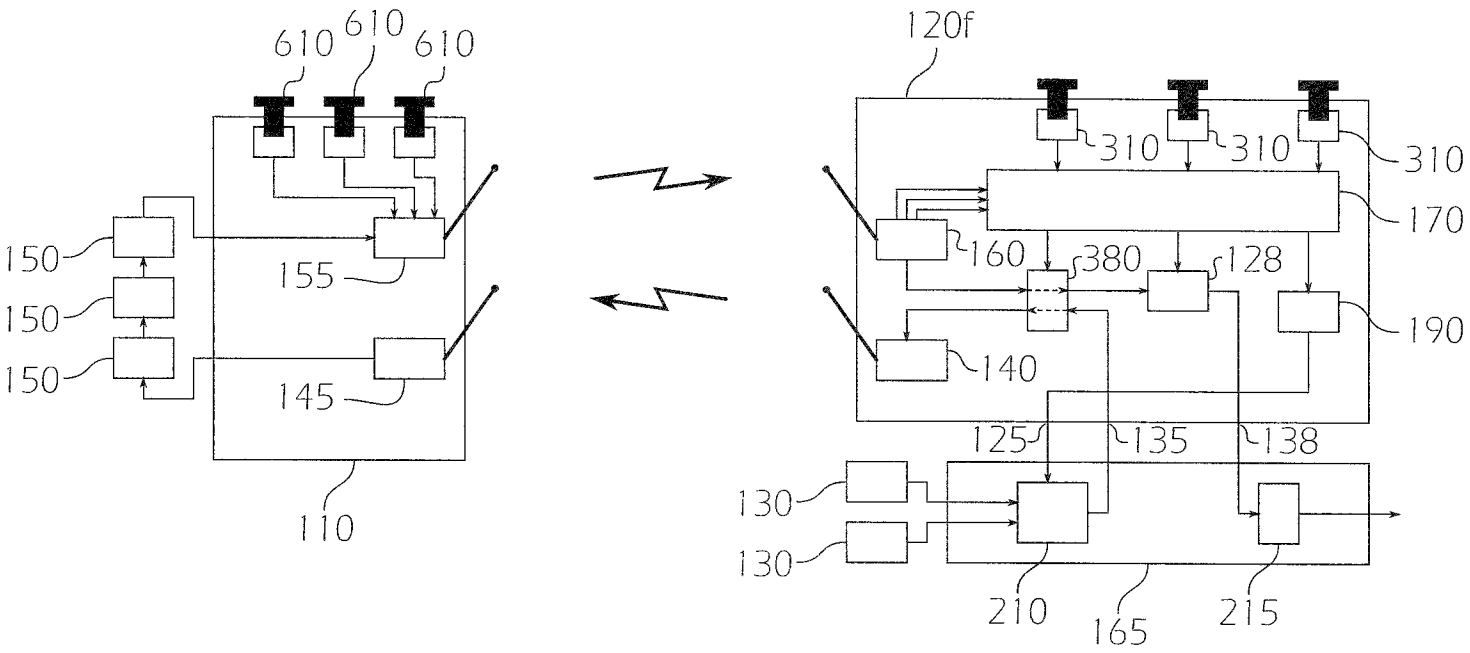
FIG. 7 is a block diagram of a system for wireless remote installation of effects pedals including a central control unit according to an embodiment of the present invention.

Referring to FIG. 7, in another embodiment, the main unit 120*f* may contain a central control unit 170 which may control the audio signal routing block 380, mute block 128, or control blocks 190. The central control unit 170 may include one or more processors executing computer program instructions and interacting with other system components for performing the various suitable functionalities described herein. The computer program instructions may be stored in a memory implemented using a standard memory device, such as, for example, a random access memory (RAM). The computer program instructions may also be stored in other non-transitory computer readable media such as, for example, a CD-ROM, flash drive, or the like.

In this embodiment the central control unit 170 may merge control inputs received from the floor unit 110 and from the main unit control switches 310, to effect any desired state changes. The central control unit 170 may, for example, receive control inputs from the main unit wireless receiver 160 and from the main unit control switches 310 and determine the appropriate control signal for an audio signal routing block 380, a mute block 128, or a control block 190. Moreover, the central control unit 170 may allow a state change in the main unit 120*f* to be triggered by momentary activation of a momentary contact switch, so that, for example, pressing and releasing a mute button once may switch the main unit 120*f* into the muted state, and pressing and releasing the mute button again may switch the main unit 120*f* into the unmuted state. In another embodiment, if the mute control switches on the main unit 120*f* and on the floor unit 110 are both momentary contact switches and a toggle effect is desired, in which the main unit 120*f* toggles between a muted state and an unmuted state each time either switch is pressed and released, then the central control unit 170 may provide this functionality using a state machine implemented in hardware or software or a combination thereof.

Figure 8:
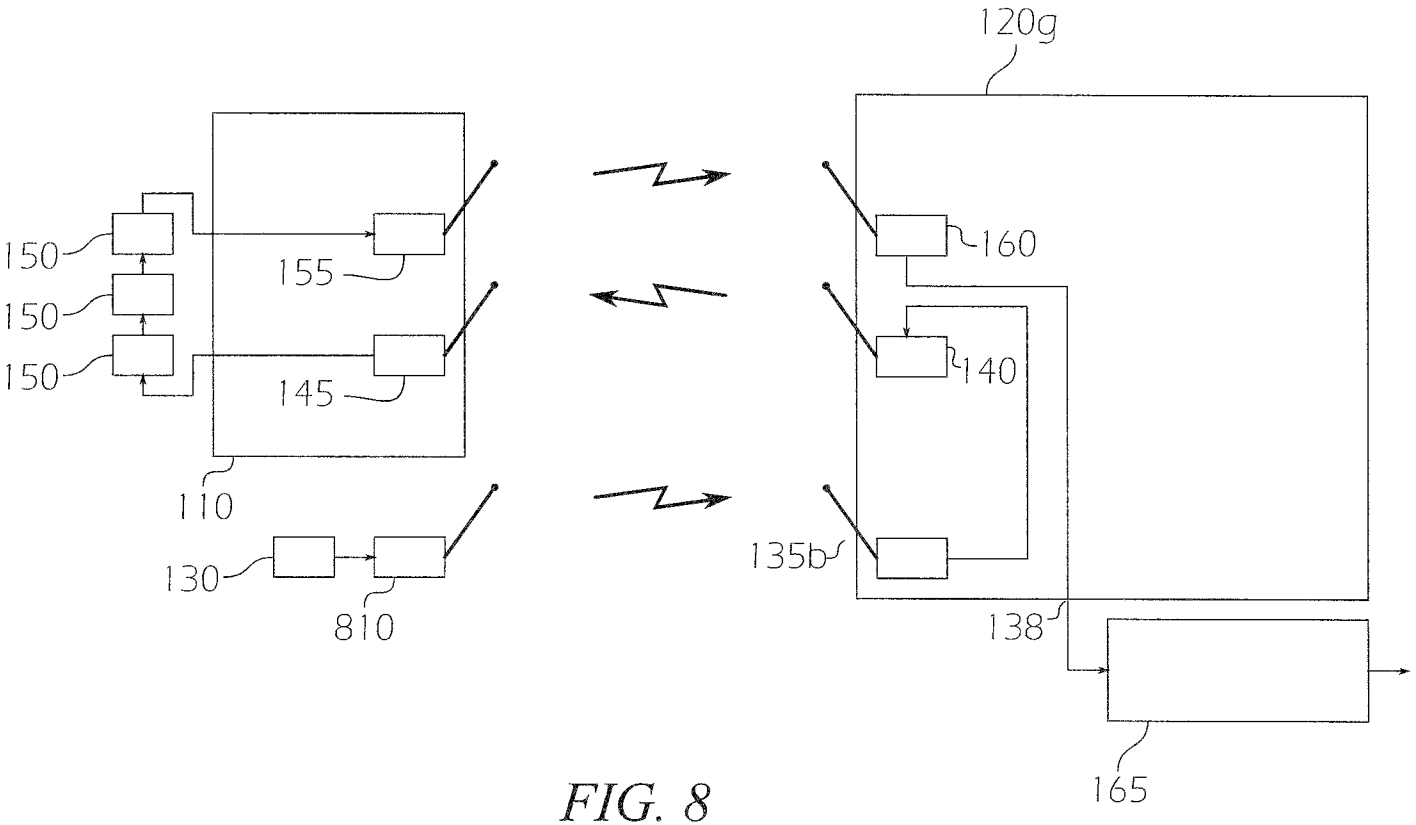
FIG. 8 is a block diagram of a system for wireless remote installation of effects pedals with a wireless audio source connection according to an embodiment of the present invention.

In one embodiment, the need for a cable between the audio source 130 and the main unit or the amplifier 165 may be eliminated using an additional wireless link. Referring to FIG. 8, the main unit 120*g* may contain an additional wireless receiver, which in this embodiment acts as the main unit audio input 135*b*. The audio source 130 may then be connected to a corresponding audio source wireless transmitter 810, so that the audio signal is transmitted from the audio source 130 to the main unit audio input 135*b* via the additional wireless link.

In one embodiment, the wireless transmitter 810 may be a body-pack wireless transmitter 810, e.g., a wireless transmitter 810 suitable for being secured to the body of a musician, who may then plug a signal source 130 into the body-pack wireless transmitter 810. The signal source 130 may for example be a microphone, electric guitar, or a piece of studio equipment.

Although limited embodiments of the ultimate flexibility wireless system for remote audio effects have been specifically described and illustrated herein, many modifications and variations will be apparent to those skilled in the art. Accordingly, it is to be understood that the ultimate flexibility wireless system for remote audio effects constructed according to principles of this invention may be embodied other than as specifically described herein. The invention is also defined in the following claims, and equivalents thereof.

What is claimed is:

1. A method for processing an audio signal by a main unit and a floor unit, the main unit comprising an audio input, an audio output, a main unit wireless transmitter and a main unit wireless receiver, and the floor unit comprising an effects send output, an effects return input, a floor unit wireless transmitter and a floor unit wireless receiver, the method comprising:

routing the audio signal from the audio input to the main unit wireless transmitter;

transmitting the audio signal from the main unit wireless transmitter to the floor unit wireless receiver;

routing the audio signal from the floor unit wireless receiver to the effects send output;

routing the audio signal from the effects return input to the floor unit wireless transmitter;

transmitting the audio signal from the floor unit wireless transmitter to the main unit wireless receiver; and routing the audio signal from the main unit wireless receiver to the audio output selectively operating in a first audio control state and a second audio control state where one of the audio control states comprises the routing of the audio signal from the audio input directly to the audio output; wherein the floor unit further comprises a physically actuated switch; and further transmitting a control signal from the physically actuated switch to the main unit wireless receiver, and transitioning from one of the first audio control state and the second audio control state to the other one of the first audio control state and the second audio control state when the physically actuated switch is activated after having been deactivated.

2. The method of claim 1, wherein the operating in the first audio control state comprising:

the routing of the audio signal from the audio input to the main unit wireless transmitter;

the transmitting of the audio signal from the main unit wireless transmitter to the floor unit wireless receiver;

the routing of the audio signal from the floor unit wireless receiver to the effects send output;

the routing of the audio signal from the effects return input to the floor unit wireless transmitter;

the transmitting of the audio signal from the floor unit wireless transmitter to the main unit wireless receiver; and the routing of the audio signal from the main unit wireless receiver to the audio output, and the operating in the second audio control state comprising: the routing of the audio signal from the audio input to the audio output.

3. The method of claim 2, wherein the main unit further comprises a physically actuated switch, and the method further comprises:

operating the main unit in the first audio control state when the physically actuated switch of the main unit is activated; and operating the main unit in the second audio control state when the physically actuated switch of the main unit is deactivated.

4. The method of claim 3, wherein the physically actuated switch of the main unit is a manually actuated switch.

5. The method of claim 2, wherein:

the main unit further comprises a physically actuated switch; and the method further comprises transitioning from one of the first audio control state and the second audio control state to the other one of the first audio control state and the second audio control state when the physically actuated switch of the main unit is activated after having been deactivated.

6. The method of claim 2, wherein:

the method further comprises:

transmitting a control signal from the physically actuated switch of the floor unit to the main unit wireless receiver; and operating in the first audio control state when the physically actuated switch of the floor unit is activated; and operating in the second audio control state when the physically actuated switch of the floor unit is deactivated.

7. The method of claim 6, wherein the physically actuated switch is a foot actuated switch.

8. The method of claim 2, wherein the main unit further comprises a physically actuated switch; and the method further comprises:

transmitting a control signal from the physically actuated switch of the floor unit to the main unit wireless receiver; and transitioning from one of the first audio control state and the second audio control state to the other one of the first audio control state and the second audio control state when the physically actuated switch of the main unit is activated after having been deactivated, or the physically actuated switch of the floor unit is activated after having been deactivated.

9. The method of claim 2, further comprising selectively operating in an unmuted state or a muted state, wherein, in the muted state, the audio output is disabled.

10. The method of claim 9, wherein:

the main unit further comprises a physically actuated switch; and the method further comprises operating in the muted state when the physically actuated switch of the main unit is activated.

11. The method of claim 9, further comprising:

transmitting a control signal from a physically actuated switch to the main unit wireless receiver, and operating in the muted state when the physically actuated switch is activated.

12. The method of claim 2, wherein:

the main unit further comprises a switching control connector comprising a conductor; and the method further comprises selectively operating in a first control output state or a second control output state, wherein, when the main unit is selected to operate in the first control output state, the conductor is disconnected, and when the main unit selected to operate in the second control output state, the conductor is connected to ground.

13. The method of claim 2, further comprising transmitting the audio signal from the floor unit wireless transmitter to the main unit wireless receiver using a wireless link having multiple channels.

14. The method of claim 13, wherein the wireless link employs spread spectrum technology.

15. The method of claim 2, wherein the audio input is a wireless audio input.

16. The method of claim 15, further comprising transmitting an audio signal from a body-pack wireless transmitter to the audio input.

17. The method of claim 16, further comprising, accepting, by the body-pack wireless transmitter, audio input from a source selected from the group consisting of guitars, microphones, pieces of studio equipment, and combinations thereof.

18. The method of claim 2, further comprising:

transmitting the audio signal from an audio signal source to a preamplifier input of an audio amplifier comprising:

the preamplifier input;

a preamplifier output; and a power amplifier input;

transmitting the audio signal from the preamplifier output to the audio input; and transmitting the audio signal from the audio output to the power amplifier input.

19. The method of claim 18, wherein the transmitting of the audio signal from the audio signal source to the preamplifier input comprises transmitting the audio signal via a wireless audio link.

20. The method of claim 19, wherein the wireless link comprises a body-pack wireless transmitter.

21. The method of claim 20, further comprising, receiving, by the body-pack wireless transmitter, the audio signal from the audio signal source, wherein the audio signal source is selected from the group consisting of guitars, microphones, pieces of studio equipment, and combinations thereof.

* * * * *